United States Patent [19]

Henning

[11] 4,402,474

[45] Sep. 6, 1983

[54] CYLINDRICAL COIL CARRIER FOR RECEIVING THREADS AND YARNS

[75] Inventor: Walter Henning, Alsdorf-Hoengen, Fed. Rep. of Germany

[73] Assignee: Messrs. Jos. Zimmerman, Aachen, Fed. Rep. of Germany

[21] Appl. No.: 303,383

[22] Filed: Sep. 18, 1981

[30] Foreign Application Priority Data

Sep. 26, 1980 [DE] Fed. Rep. of Germany ..... 3036247

[51] Int. Cl.[3] ..... B65H 75/20

[52] U.S. Cl. ..... 242/118.1; 68/198

[58] Field of Search ..... 242/118.1, 118.3, 118.31, 242/118.32, 118.41, 128, 129; 68/189, 198

[56] References Cited

U.S. PATENT DOCUMENTS

| | | | |
|---|---|---|---|
| 2,390,157 | 12/1945 | Kramer | 242/128 |
| 2,828,091 | 3/1958 | Bell | 242/128 |
| 3,269,672 | 8/1966 | Steinback | 242/128 |
| 3,430,886 | 3/1969 | Sweeney | 242/118.41 X |
| 4,180,219 | 12/1979 | Becker et al. | 242/118.3 X |
| 4,272,037 | 6/1981 | Becker et al. | 242/118.1 |

*Primary Examiner*—Leonard D. Christian
*Attorney, Agent, or Firm*—Finnegan, Henderson, Farabow, Garrett & Dunner

[57] ABSTRACT

In a coil carrier for receiving threads and yarns and comprising webs which extend substantially parallel to the axis and are interconnected by circumferential supporting rings, the foot section defines a receptacle for a head section of an adjacent like coil carrier. The coil carrier comprises a supporting member and a sliding member axially displaceable relatively thereto, the external diameters of the supporting and sliding members being substantially equal.

17 Claims, 8 Drawing Figures

6
1
37
36
17
6
23
1
14
19
12
13
16
3
3
4
2
40
41
3
3
32
23
23
4

CYLINDRICAL COIL CARRIER FOR RECEIVING THREADS AND YARNS

The invention relates to a cylindrical coil carrier for receiving threads and yarns, comprising webs which extend substantially parallel to the axis and are interconnected by circumferential supporting rings, and a foot section as well as a head section, the foot section defining a receptacle for the head section of an adjacent like coil carrier.

Coil carriers for coils of threads and yarns are already known, which can be compressed or telescoped in the axial direction and are used for the wet treatment of coils of threads and yarns, for example for dyeing purposes.

One known coil carrier of this kind (DE-GM No. 71 02 230) consists of two sleeve members of the same diameter having axially parallel supporting elements equally spaced in the circumferential direction, the supporting elements of the one sleeve member engaging in gaps between the supporting elements of the other sleeve member. Such a coil carrier is quite complicated to make and therefore expensive.

A coil carrier is also known, which has only one end ring from which loop-shaped supporting elements extend. The supporting elements, made of wire in the known coil carrier, are elastically deformable so that the end of the coil carrier remote from the end ring can be introduced into that end of a second coil carrier which is provided with an end ring. The manufacture of this known coil carrier is likewise expensive. In addition, this known coil carrier has the disadvantage that coils cannot be formed directly on it and it does not possess optimum rotating properties. Further, after compressing the known coil carrier, it is impossible to achieve a uniform density for the coil of thread or yarn because the extent by which a coil carrier can be inserted in the other cannot be limited precisely.

Finally, a coil carrier is known (DE-OS No. 28 10 163), which is substantially shape-retaining and comprises an end ring with supporting elements extending therefrom parallel to the axis of the coil carrier. These supporting elements are divided into two sections, the first section adjacent the end ring comprising two limbs each of which is secured to the end ring by one end on one side of an aperture of the end ring, the limbs converging at an acute angle up to the end of this first section that is remote from the end ring. The second section of the supporting elements is in the form of an axially parallel rod element. Such coil carriers can be inserted into each other, the rod elements of the one coil carrier entering the apertures of the end ring of an adjacent coil carrier and between the converging limbs of the first section of this coil carrier. This coil carrier is simple to make, particularly of plastics material. Coils can be formed directly on it with the aid of known spooling machines. For transport and storage, a plurality of these coil carriers can be inserted in each other to save considerable space. In this known coil carrier which is generally very advantageous, it can however be a disadvantage for certain applications that it necessarily cannot have the same diameter in all sectional planes normal to the carrier axis. In the region of the end ring, it must necessarily have a larger external diameter in comparison with the remaining length. This can produce disadvantages during coiling as well as uncoiling.

It is the object of the present invention to provide a coil carrier of the aforementioned kind which possesses the advantages of the last-mentioned known coil carrier and also has a continuous cylindrical coiling surface without any reductions in diameter.

This object is fulfilled in accordance with the invention in a coil carrier of the aforementioned kind in that it comprises a supporting member and a sliding member axially displaceable in relation thereto, that the supporting member comprises a first cylindrical section adjacent its foot section, with web sections projecting radially outwardly beyond the supporting rings, and a cylindrical head section of smaller external diameter adjoining the first cylindrical section, that the sliding member is a radially apertured cylindrical body of internal diameter substantially equal to the external diameter of the cylindrical head section and of external diameter corresponding to the external diameter of the first cylindrical section, and that the sliding member comprises guides co-operating with the projecting web sections of the first cylindrical section.

In this coil carrier, the sliding member ensures that the coil carrier will have the same diameter throughout from the foot to the head during coiling. However, the sliding member will not impede the insertion of adjacent like carriers into each other and will thus permit compression of the coils of thread or yarn in known manner. The guides advantageously provide a loose guide for the sliding member on the supporting member. This guiding effect can also be achieved in that webs of the sliding member co-operate with guides of the supporting member. Further, a reversal of this construction is conceivable in that the sliding member is arranged on the supporting member of which the foot section will then have a reduced external diameter.

Further features of the inventive concept will be apparent from the subsidiary claims and are explained in detail in the description.

One embodiment of coil carrier according to the invention will now be described with reference to the drawings, in which.

Figure 1:
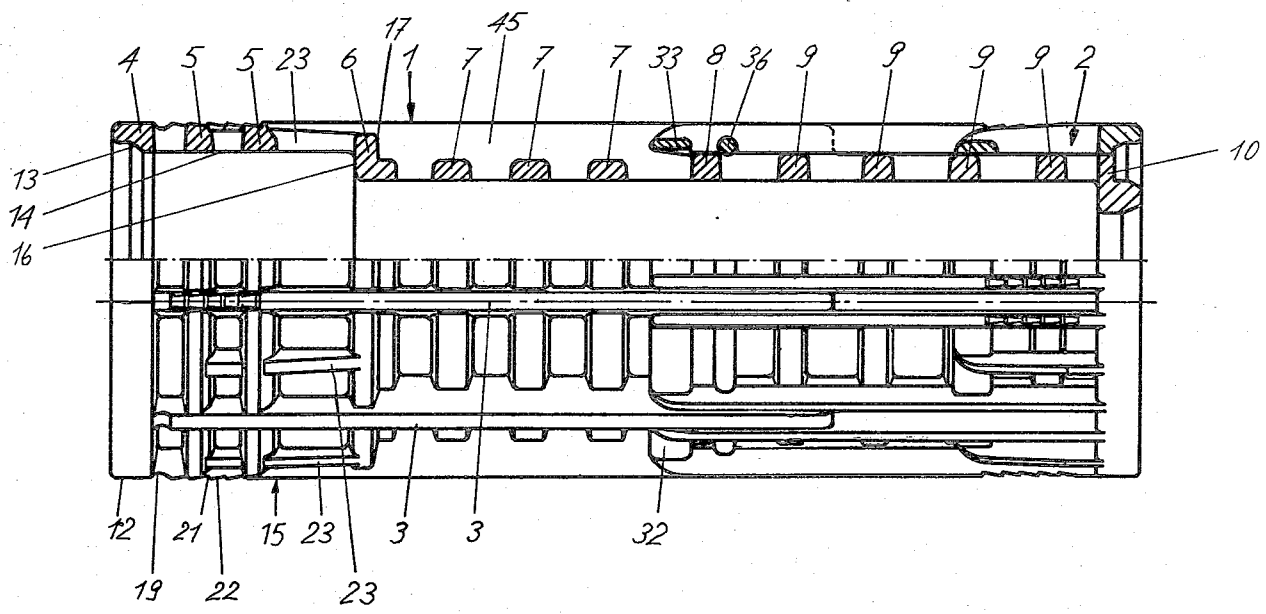
FIG. 1 is a part-sectional side elevation of an embodiment of coil carrier according to the invention comprising a supporting member and a sliding member.
Figure 2:
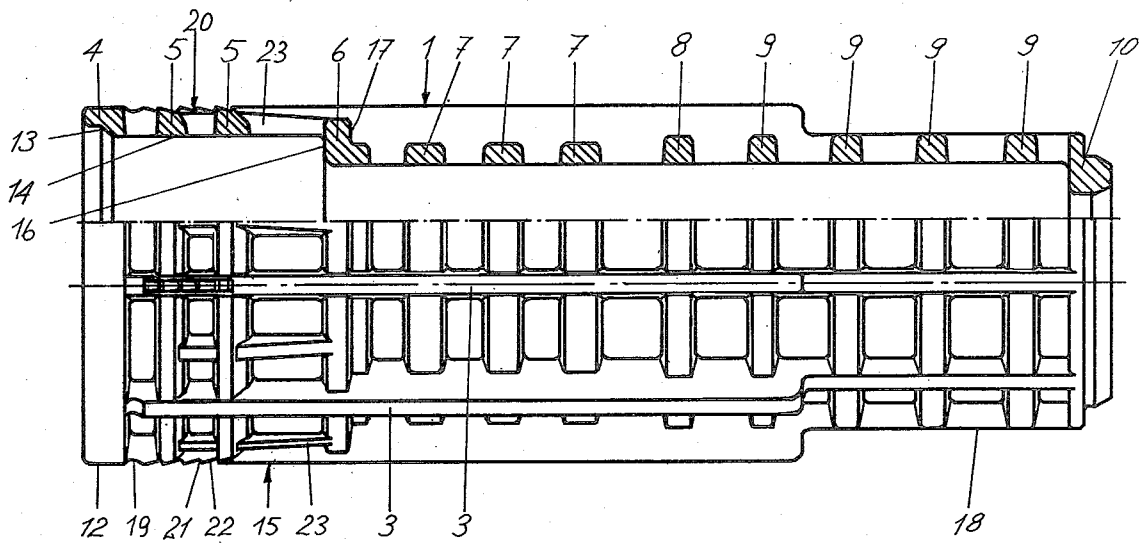
FIG. 2 is a part-sectional side elevation of the supporting member of the FIG. 1 coil carrier according to the invention.
Figure 3:
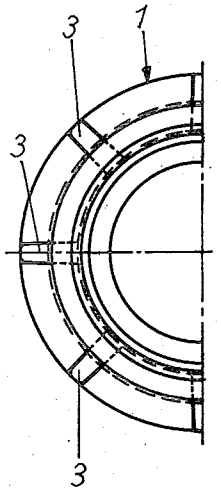
FIG. 3 is a fragmentary plan view of the head end of the FIG. 2 supporting member.

The coil carrier according to the invention in the embodiment illustrated in the drawings is formed by a supporting member 1 and a sliding member 2.

The supporting member 1 has a row of webs 3 extending parallel to the axis of the coil carrier. These webs 3 are connected by a number of circumferentially extending supporting rings 4 to 10 to form a substantially shape-retaining body. In the illustrated example, the supporting ring 4 is disposed at the foot of the supporting member 1 and thus at the foot of the coil carrier. It has a cylindrical outer surface 12 corresponding to the external diameter which is substantially the same over the entire sleeve length. This supporting ring 4 has an internal surface 13 defining a receiving aperture which increases towards the foot.

In the illustrated embodiment, further supporting rings 5 of substantially the same construction follow the supporting ring 4 at a spacing. The internal diameters of these supporting rings 5 correspond to the smallest diameter of the supporting ring 4 and therefore define the external diameter of a receptacle 14 in the foot section 15 of the supporting member 1.

A further supporting ring 6 projects radially inwardly relatively to the supporting rings 4 and 5 and forms an abutment face 16 facing the foot as well as an abutment face 17 facing the head.

Axially spaced from the supporting ring 6, the illustrated embodiment comprises three further supporting rings 7 of corresponding external and internal diameter, the external diameter of these supporting rings 7 being less than the external diameter of the supporting ring 4.

Axially displaced further towards the head of the supporting member 1 and parallel to the supporting rings 7 there is the supporting ring 8 of which the internal diameter is desirably the same as the internal diameters of the supporting rings 6 and 7 but the external diameter is preferably slightly larger than the external diameter of the supporting rings 7.

Further displaced towards the head of the supporting member and at a spacing from the supporting ring 8 there are additional supporting rings 9 of which the internal diameters are desirably equal to the internal diameter of the supporting rings 6, 7 and 8 whereas the external diameter of the supporting rings 9 is equal to or slightly less than the external diameter of the supporting ring 8. The supporting member 1 is bounded at its head end by the terminal supporting ring 10 of which the external diameter desirably corresponds to the external diameter of the supporting rings 9 whereas the internal diameter of the supporting ring 10 is less than the diameter of the other supporting rings.

The webs 3 extend from the supporting ring 4 at the foot up to the supporting ring 10 at the head. In the foot section 15, they have a common cylindrical enveloping surface formed by their external surfaces. In the head section 18, the external surfaces of the webs 3 are set back radially inwardly and form a cylindrical enveloping surface of which the external diameter is less than the external diameter of the enveloping surface of the foot section 15. At the same time, the external diameter of the enveloping surface of the head section 18 corresponds to the internal diameter of the receptacle 14 of the foot section 15 so that the head section 18 of a coil carrier can be introduced into the receptacle 14.

The external surfaces of the webs 3 define a throat 19 near the supporting ring 4 for receiving a reserve amount of thread. Further, they are in the illustrated embodiment provided with anti-sliding means 20 which comprise steeply radially inwardly set back stop faces 21 directed towards the foot as well as slide faces 22 which gradually rise outwardly towards the foot. In the illustrated embodiment, in the vicinity of the supporting rings 5 and 6 between the webs 3 there are additional supporting webs 23 of which the outer faces are offset radially inwardly with respect to the outer faces of the webs 3 and rise gradually towards the foot. These supporting webs 23 thus facilitate displacement of the coil of yarn towards the foot of the coil carrier.

Figure 6:
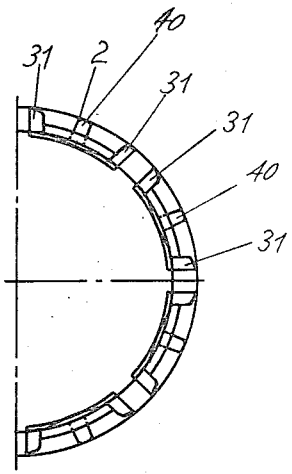
FIG. 6 is a fragmentary view of the sliding member taken in the direction of the arrow VI in FIG. 4.
Figure 4:
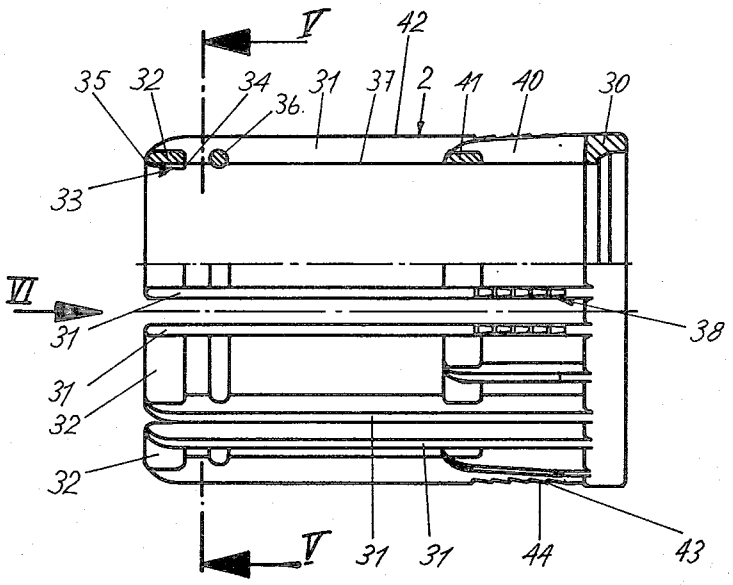
FIG. 4 is a part-sectional side elevation of one embodiment of the sliding member.
Figure 5:
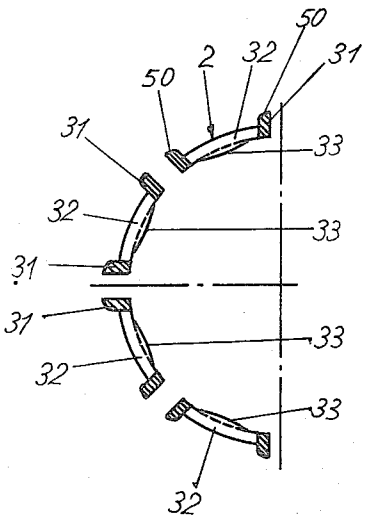
FIG. 5 is a partial section through the sliding member on the line V—V in FIG. 4.

The sliding member 2 (FIGS. 4 to 6) is formed by an end ring 30 from which webs 31 extend parallel to the axis. Each two circumferentially adjacent webs 31 are at a spacing from each other substantially corresponding to the circumferential extent of one web 3 of the supporting member 1. Each of these pairs of webs forms a guide for the sliding member 2 on the supporting member 1.

The sliding member 2 comprises a sliding web 40 extending from its end ring 30 and between each two guides formed by pairs of webs. This sliding web 40 extends parallel to the webs 31 but over only part of the axial length of the sliding member 2. The external surface of the sliding webs 40 is radially inwardly inclined from the end ring 30. A connecting ring 41 couples the free ends of the sliding webs 40 by means of the pairs of webs 31 forming a guide. These sliding webs 40 facilitate sliding of the sliding member 2 beneath the coil of yarn. The sliding web 40 can likewise be provided with anti-slide means, as will be described in conjunction with the webs 31.

The webs 31 which form guides in pairs are chamferred at 50 at the radially outer edges so that the external surfaces of the these webs 31 are substantially adapted to the direction of the filaments between adjacent edges of the webs 3 of the supporting member 1 during displacement of the sliding member 2 relatively to a coil and so that no complications arise during traversing beneath the coil.

Between the guides, the webs 31 are connected near their free ends by ring members 32. These ring members 32 carry radially inwardly projecting stop lugs 33 at their inner surface. The lugs have a steeply set back stop face 34 facing the end ring 30 and a gradually rising slide face 35.

Axially spaced to the ring members 32, a resilient stop ring 36 is provided between the guides formed by the webs 31. The stop ring projects slightly radially inwardly beyond the internal surfaces 37 of the webs 31 and the ring members 32 and is at a spacing from the stop lugs 33 equal to or larger than the axially measured width of the supporting ring 8 of the supporting member 1. Thus, in the initial position of the sliding member 2 on the supporting member 1 there is a locking connection which can be readily released under pressure. The internal surfaces 37 of the webs 31 lie on a cylindrical surface having a diameter substantially corresponding to that of the enveloping surface of the head section 18 of the supporting member 1.

The webs 31 have exterior surfaces 42 which extend into an enveloping surface of which the diameter corresponds to that of the enveloping surface of the foot section 15 of the supporting member 1. Anti-slide means 38 provided in the external surfaces 42 of the webs 31 comprise steeply radially inwardly set back stop faces 43 facing the end ring 30 and gradually outwardly rising slide faces 44.

The webs 31 are rounded or chamferred at their free ends on the radially outer side to facilitate displacement of the sliding member 2 beneath the inner convolutions of a coil.

FIG. 1 shows a coil carrier according to the invention in its starting position. The sliding member 2 is releasably fixed to the supporting member 1 in that the supporting ring 8 is engaged on the one side by the stop lugs 33 of the ring members 32 and on the other side by the stop ring 36. FIG. 1 makes it clear that in the starting position the sliding member 2 gives the coil carrier a completely constant external diameter over the entire axial extent. The webs 31 of the sliding member 2 combined in pairs to form guides in each case engage the sections 45 of the webs 3 laterally, which project radially beyond the supporting rings 7 to 9.

With the coil carrier according to the invention, it is possible accurately to set the extent by which one coil carrier can be inserted in another. More particularly, this extent can be defined by the axial extent of the receptacle 14, by the length of the webs 31 of the sliding member 2, as well as by the axial extent of the foot section 18 of the supporting member 1 with reduced external diameter.

Figure 7:
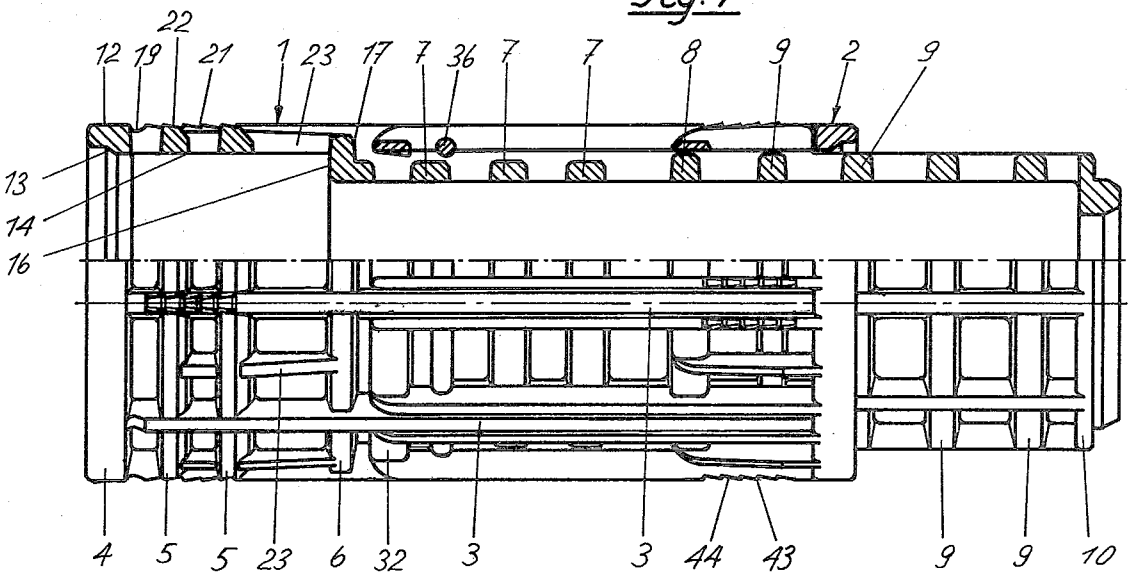
FIG. 7 is a part-sectional side elevation of the coil carrier according to the invention with the sliding member displaced relatively to the initial position of FIG. 1.
Figure 8:
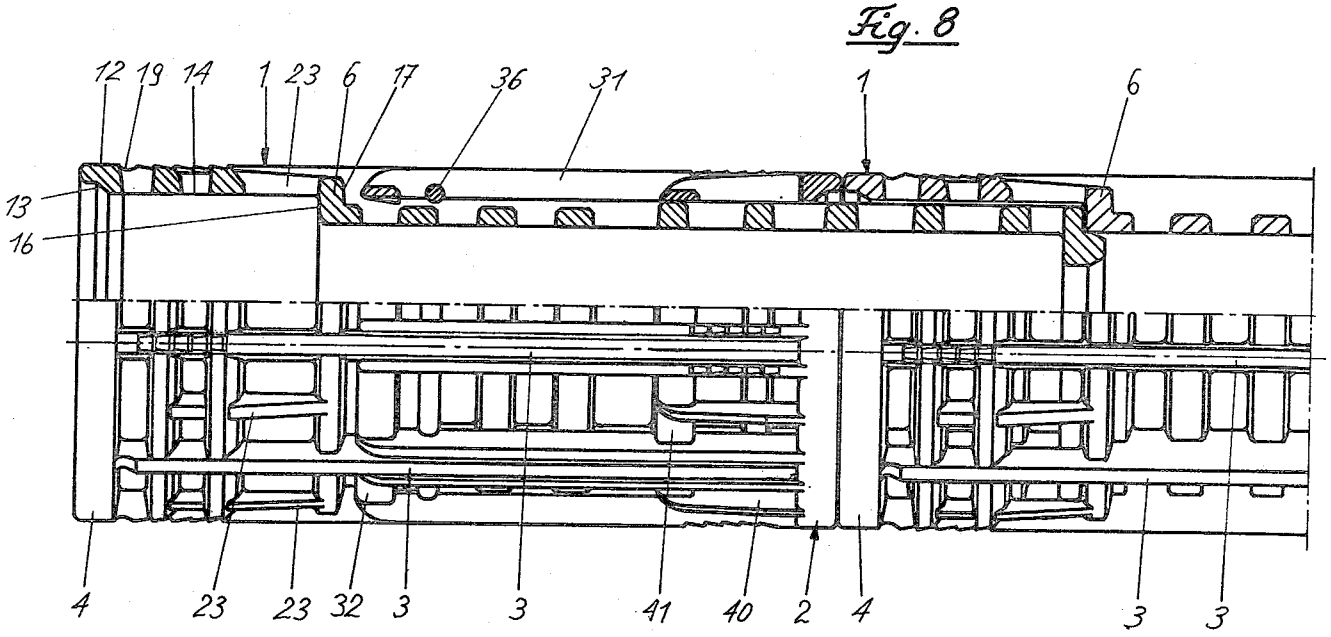
FIG. 8 is a part-sectional side elevation of two coil carriers according to the invention in the compressed condition.

After compression of the coil carrier here in question, it is necessary to return the sliding member 2 from the FIG. 7 position to the starting position shown in FIG. 1.

The anti-slide means 20 of the supporting member 1 as well as the anti-slide means 38 serve to fix the inner convolutions of the coil during spooling in so far that they prevent sliding towards the axial centre of the coil carrier. These anti-slide means 20, 38 do, however, permit displacement of the sliding member 2 relatively to the coil as well as displacement of the inner yarn layers towards the respective coil carrier foot or towards the lower end of the coils which are superposed to form a column.

It is readily possible to change particularly the number of webs and supporting rings to meet particular requirements.

By means of different colouring, it can be made easier to determine whether the sliding member 2 of the coil carrier is in its starting position on the supporting member 1. Such colouring may also identify the direction of spooling if the head and foot of the coil carrier are defined by different colours.

I claim:

1. A cylindrical coil carrier for receiving threads and yarns, said carrier comprising webs which extend substantially parallel to the axis of said carrier and are interconnected by circumferential supporting rings, said carrier having a foot section and a head section, the foot section defining a receptacle for receiving the head section of the adjacent like coil carrier, said coil carrier further including a supporting member and a sliding member axially displaceable relative thereto, said supporting member including a first cylindrical section adjacent said foot section and web sections projecting radially outwardly beyond said supporting rings, said head section including a cylindrical section adjoining the first cylindrical section and having a smaller external diameter than said first cylindrical section, said sliding member being a radially apertured cylindrical body having an internal diameter substantially equal to the external diameter of the cylindrical head section and an external diameter corresponding to the external diameter of the first cylindrical section, said sliding member including guides cooperating with the projecting web sections of the first cylindrical section.

2. A coil carrier as claimed in claim 1, said carrier including at least one supporting web extending from said foot section between each adjacent pair of first mentioned webs and parallel thereto, said at least one supporting web extending over only part of the axial length of the coil carrier and having an external surface which is inclined radially inwardly in a direction away from the foot section.

3. A coil carrier as claimed in claim 1, said sliding member including an end ring and parallel webs which extend axially of said sliding member from said end ring, each two circumferentially adjacent webs of said sliding member defining a guide which cooperates with a web section of the first cylindrical section.

4. A coil carrier as claimed in claim 3, said sliding member comprising at least one sliding web extending from the end ring of the sliding member between each two of its webs and parallel thereto, said sliding web extending over only part of the axial length of the sliding member and having an external surface which is inclined radially inwardly in a direction away from said end ring.

5. A coil carrier as claimed in claim 4, wherein circumferentially adjacent pairs of webs of the sliding member form guides, the radially outwardly disposed edges of each pair of sliding member webs that face away from each other being chamferred.

6. A coil carrier as claimed in claim 1, wherein a locking connection releasably holding the sliding member in a starting position is provided between the supporting member and the sliding member.

7. A coil carrier as claimed in claim 5, wherein the sliding member webs are connected by ring members between the guides.

8. A coil carrier as claimed in claim 7, wherein the outwardly disposed sides of the sliding member webs are chamferred at their ends remote from the end ring.

9. A coil carrier as claimed in claim 7, wherein the webs on at least one of the sliding member and the ring member include radially inwardly directed stop lugs, a resiliently yielding circumferentially extending stop ring disposed between the guides and spaced axially from the stop lug and offset toward the end ring, said stop lugs and stop ring engaging opposite sides of a supporting ring of the supporting member in a starting position of the coil carrier.

10. A coil carrier as claimed in claim 3, said sliding member having radially outwardly disposed surface sections formed with anti-sliding means including steeply radially inwardly set back stop faces directed towards the end ring of the sliding member, and slide faces which gradually rise outwardly toward the end ring.

11. A coil carrier as claimed in claim 10, wherein said anti-sliding means are provided in the outer faces of the sliding member webs.

12. A coil carrier as claimed in claim 1, wherein the external diameter of the cylindrical head section is equal to or smaller than the diameter of the receptacle in the foot section of the supporting member.

13. A coil carrier as claimed in claim 12, wherein the axial extent of the receptacle is limited by a radially inwardly projecting supporting ring.

14. A coil carrier as claimed in claim 13, wherein the axial extent of the receptacle is less than the axial extent of the cylindrical head section.

15. A coil carrier as claimed in claim 1, wherein the axial extent of the receptacle is greater than the axial extent of the cylindrical head section.

16. A coil carrier as claimed in claim 1, said webs of the supporting member including throats in the outer faces thereof for receiving a reserve amount of thread.

17. A coil carrier as claimed in claim 1, wherein the foot section of the supporting member includes anti-sliding means having steeply radially inwardly set back stop faces facing the foot section and slide faces which gradually rise outwardly toward the foot section on the outer surface thereof.

* * * * *